US011243015B2

(12) United States Patent
Braz et al.

(10) Patent No.: US 11,243,015 B2
(45) Date of Patent: Feb. 8, 2022

(54) REFRIGERATION SYSTEM AND METHOD OF USE

(71) Applicants: Marcos Braz, Arlington, TX (US); Daniel Braz, Arlington, TX (US)

(72) Inventors: Marcos Braz, Arlington, TX (US); Daniel Braz, Arlington, TX (US)

( * ) Notice: Subject to any disclaimer, the term of this patent is extended or adjusted under 35 U.S.C. 154(b) by 179 days.

(21) Appl. No.: 16/274,731

(22) Filed: Feb. 13, 2019

(65) Prior Publication Data

US 2019/0178539 A1 Jun. 13, 2019

Related U.S. Application Data

(63) Continuation of application No. 16/194,317, filed on Nov. 17, 2018, now abandoned.

(60) Provisional application No. 62/588,191, filed on Nov. 17, 2017.

(51) Int. Cl.

| | |
|---|---|
| ***F25B 39/04*** | (2006.01) |
| ***F25B 41/04*** | (2006.01) |
| ***F25B 43/04*** | (2006.01) |
| ***F25B 6/02*** | (2006.01) |
| *F25B 41/20* | (2021.01) |
| *F25B 41/40* | (2021.01) |

(52) U.S. Cl.

CPC ..... *F25B 39/04* (2013.01); *F25B 6/02* (2013.01); *F25B 43/043* (2013.01); *F25B 41/20* (2021.01); *F25B 41/40* (2021.01)

(58) Field of Classification Search

CPC ..... F25B 39/04; F25B 43/043; F25B 6/02; F25B 41/003; F25B 41/04; F25B 41/20; F25B 41/40

USPC ..... 62/419

See application file for complete search history.

(56) References Cited

U.S. PATENT DOCUMENTS

| | | | | | |
|---|---|---|---|---|---|
| 521,783 | A * | 6/1894 | Cox | F24F 5/0035 | 62/314 |
| 1,394,627 | A * | 10/1921 | Koedding | F28D 5/02 | 62/310 |
| 3,026,690 | A * | 3/1962 | Deverall | F25B 43/02 | 62/305 |
| 3,167,927 | A * | 2/1965 | Lynch | F25B 15/06 | 62/56 |
| 3,385,074 | A * | 5/1968 | Aronson | C02F 1/22 | 62/537 |
| 3,404,537 | A * | 10/1968 | Leonard, Jr. | F24F 3/14 | 62/123 |

(Continued)

*Primary Examiner* — Eric S Ruppert
*Assistant Examiner* — Kirstin U Oswald
(74) *Attorney, Agent, or Firm* — Leavitt Eldredge Law Firm

(57) ABSTRACT

A refrigeration system includes a high-pressure main header gas line; a low-pressure condensate discharge gas line; a condenser having a first port in gaseous communication with the high-pressure main header gas line; a second port in gaseous communication with the low-pressure condensate discharge gas line; a purge assembly in gaseous communication with the low-pressure condensate discharge gas line, the purge assembly is configured to purge air from the gas channeled through the low-pressure condensate discharge gas line; and an adiabatic air cooling system disposed within the condenser having a plurality of jet nozzles configured to inject a cooling gas within the condenser.

1 Claim, 7 Drawing Sheets

(56) References Cited

U.S. PATENT DOCUMENTS

| | | | | | |
|---|---|---|---|---|---|
| 3,435,631 | A * | 4/1969 | Wood, Jr. | F25B 6/04 | 62/305 |
| 3,850,009 | A * | 11/1974 | Villadsen | F22B 37/265 | 62/473 |
| 4,266,406 | A * | 5/1981 | Ellis | F25B 39/04 | 62/183 |
| 5,400,613 | A * | 3/1995 | O'Neal | F25B 43/043 | 62/195 |
| 5,411,078 | A * | 5/1995 | Ares | F24F 3/1405 | 165/113 |
| 6,178,767 | B1 * | 1/2001 | Pravda | F28D 5/02 | 62/310 |
| 6,595,011 | B1 * | 7/2003 | Forgy | F24F 5/0035 | 62/91 |
| 2007/0134526 | A1 * | 6/2007 | Numao | H01M 8/1007 | 429/414 |

* cited by examiner

REFRIGERATION SYSTEM AND METHOD OF USE

BACKGROUND

1. Field of the Invention

The present invention relates to an ammonia refrigeration system and components, and more specifically, to an air condenser cell that is modular, self-contained to be applied, including but not restricted, to a dual stage refrigeration system typically used on cold storage buildings.

2. Description of Related Art

Air conditioning systems and methods of use are well known in the art. For example, FIG. 1 depicts a conventional refrigeration cycle 101 that includes one or more of an expansion valve 103 and a compressor 105 in fluid communication with each other and configured to expand and pressurize the fluid passing through the line. The system 101 is further provided with an evaporator in fluid communication with the expansion valve 103 and configured to provide cool dry air to ambient pressure, as indicated by arrow 107. The system is also provided with a condenser in fluid communication with the compressor the produces heat from the vapor refrigerant passing through the coils, as indicated by arrows 109.

The closed system has shown to be effective in most applications of use. However, many shortcomings exist. It should be understood that air can become entrapped within the closed loop, which in turn can create pressure and temperature fluctuations. Accordingly, it is undesired to have air within the coils and requires the system to be purged of the air during regular maintenance. Such maintenance is time consuming and expensive. There is a need for a system wherein the fans are continuously monitored and fan speed controlled to maintain sub-cooling temperature set points and/or head pressure.

Although great strides have been made in the area of industrial refrigeration systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
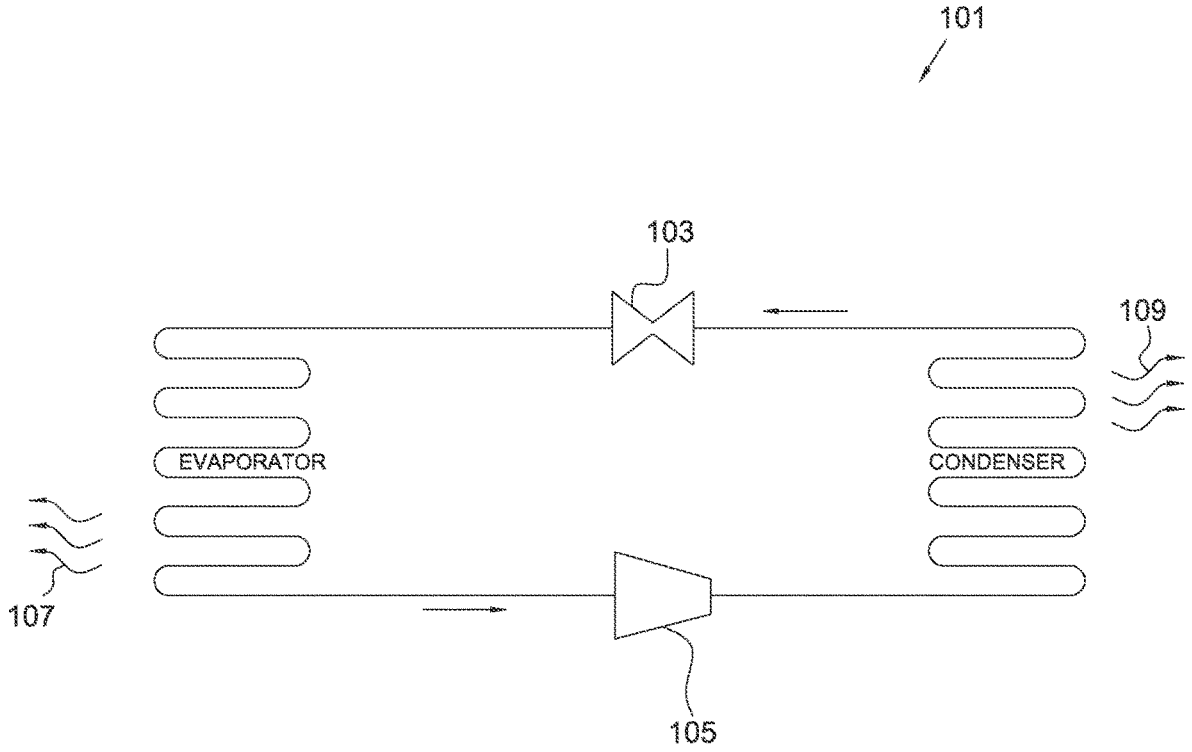
FIG. 1 (PRIOR ART)
FIG. 1 is a simplified schematic of a conventional refrigeration cycle and method of use.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional industrial refrigeration systems and methods of use. Specifically, the present invention is directed to an air condenser system with an adiabatic spray configured to spray water or mist, along with an air purge system and an assembly to control fan speed with fluctuations of fluid temperature. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the several views, FIGS. 2-6 depict various views of a system 201 and method of use in accordance with a preferred embodiment of the present application. It will be appreciated that system 201 overcomes one or more of the above-listed problems commonly associated with the conventional air conditioning systems and methods of use.

In the contemplated embodiment, system 201 includes one or more of features of system 101 with the added features of means to control fan speeds and to purge air from the closed loop coils.

Figure 2:
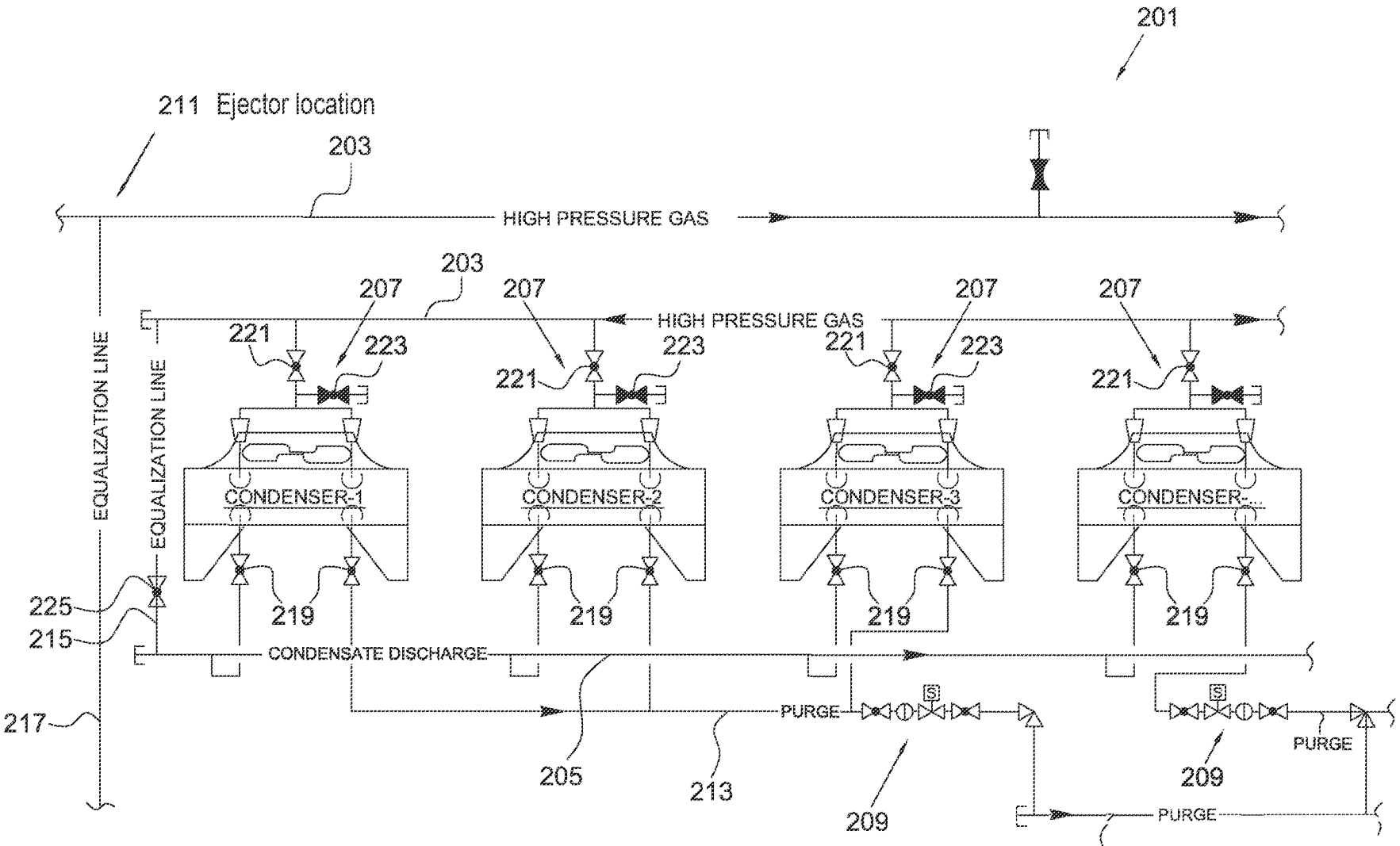
FIG. 2 is a schematic of a system and method of the present invention in accordance with the preferred embodiment of the present invention.

In FIG. 2, a schematic of system 201 is shown as way of example of one embodiment of the present invention. Two primary lines are utilized, a main header 203 configured to channel a high-pressure gas therein, and a condensate discharge line 205. A plurality of condensers 207 are in fluid communication with both lines 203 and 205 and fluid/gas passing through the condensers 207 are controlled via a plurality of valves, e.g., valves 219, 221, 225, and 227 among others not shown. The plurality of valves are configured to direct the fluid/gas in the direction indicated by the arrows disposed within the line thicknesses shown.

Figure 4:
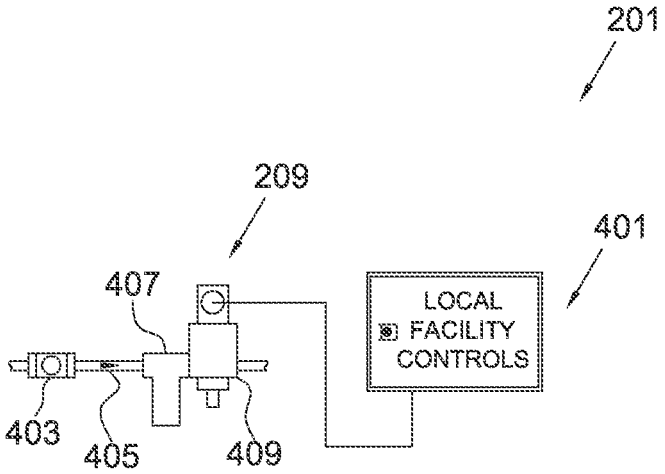
FIG. 4 is a front view of the coil air purge control valve assembly of the system of FIG. 2.

One unique feature of the present invention is the use of a purge assembly 209 in fluid communication with purge line 213. During use, the purge assembly 209 is configured to purge air from the closed loop system. As shown in FIG. 4, the purge assembly 209 includes one or more of a manual hand valve 403 in fluid communication with the purge line 213 and upstream from a filter 407, and an air purge valve 409. The fluid/gas travels through a conduit 405 in fluid communication between the devices. It will be appreciated that the air purge valve 409 is manipulated by one or more controls from a control facility 401. In one contemplated embodiment, the purge valve 409 is activated upon a determined condition occurring or after a set period of time. One or more sensors could be utilized to monitor and transmit data information to the local facility controls 401. Transmission could be achieved via wired or wireless means.

Figure 3:
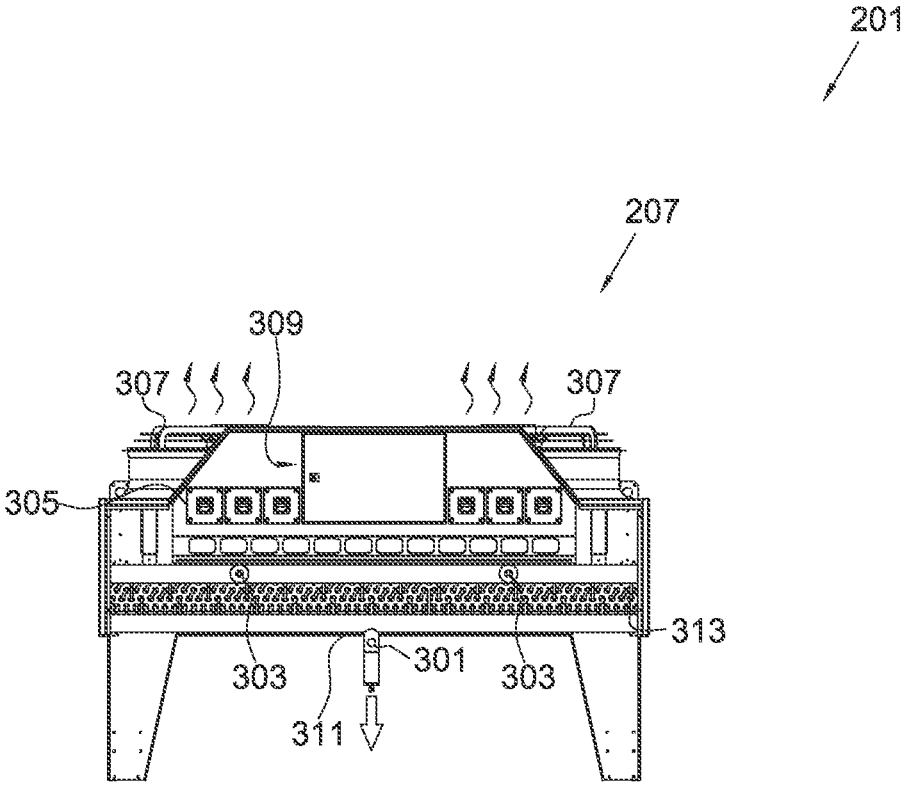
FIG. 3 is a front view of the condenser of the system of FIG. 2.
Figure 5:
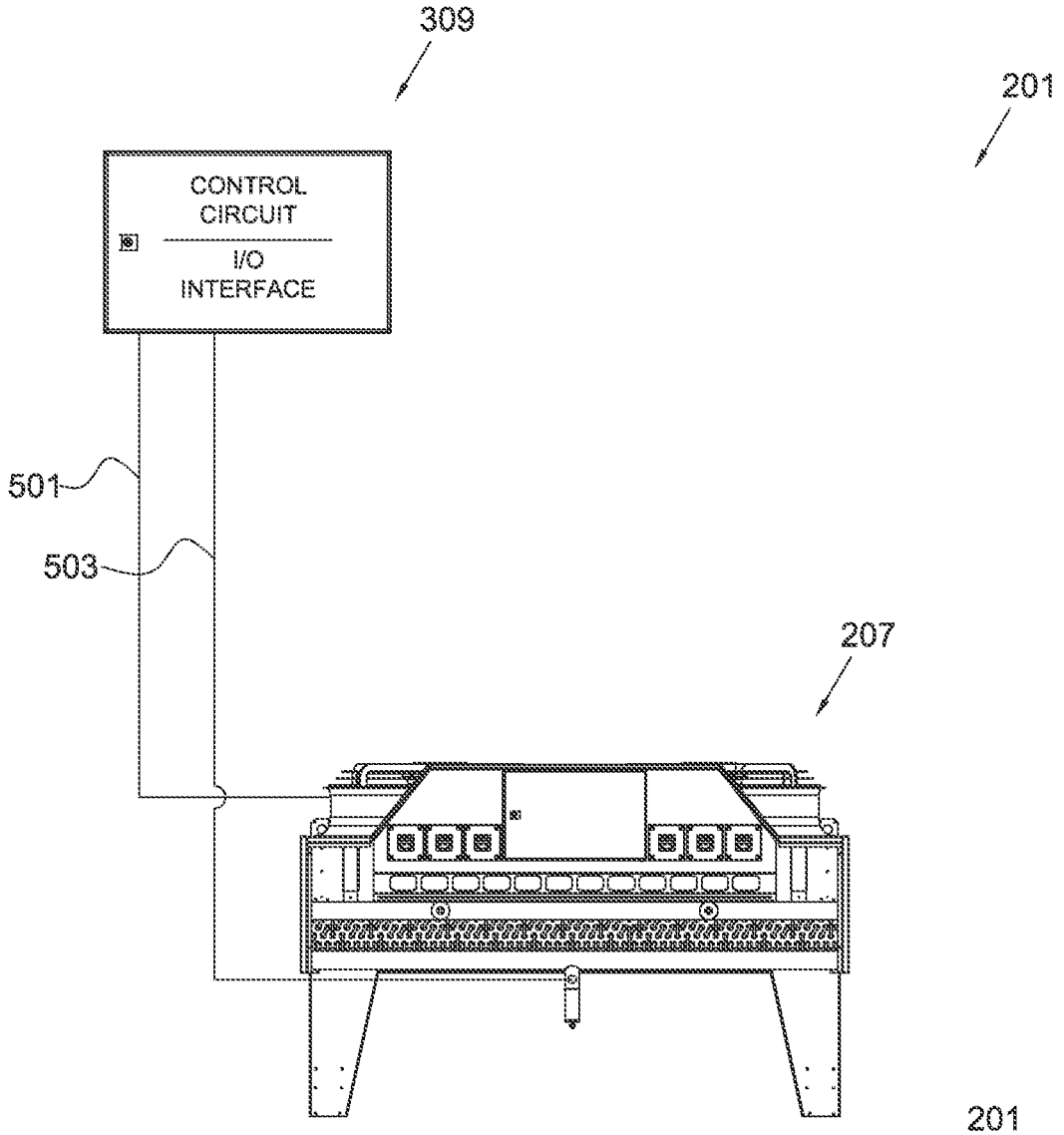
FIG. 5 is a front view of the condenser of the system of FIG. 2.

In FIG. 3, a front view of the condenser 207 is shown having one or more of a frame configured to hold a plurality of coils 313 therein an inner housing and in gaseous communication with a plurality of fans 307 secured to a top surface of the frame. During use, the plurality of fans 307 are configured to cool the fluid passing through the plurality of coils 313. High pressure fluid passes through the condenser via two high-pressure inlet ports 303 and exit through an outlet having a temperature sensor 301 secured thereto. The condenser 207 is further provided with a horizontal manifold 311 and a plurality of valve covers 303. During use, the fan speeds are controlled via a control system 309. As shown in FIG. 5, the control system 309 includes a first electrical connector 501 conductively coupled to the fans and configured to manipulate the fan speed based upon the temperature read by the one or more temperature sensors that is conductively coupled to the control system 309 via a second conductor 503. Accordingly, the control system 309 could be setup to adjust the fan speed as temperature changes occur with the fluid leaving the condenser 207.

Figure 6:
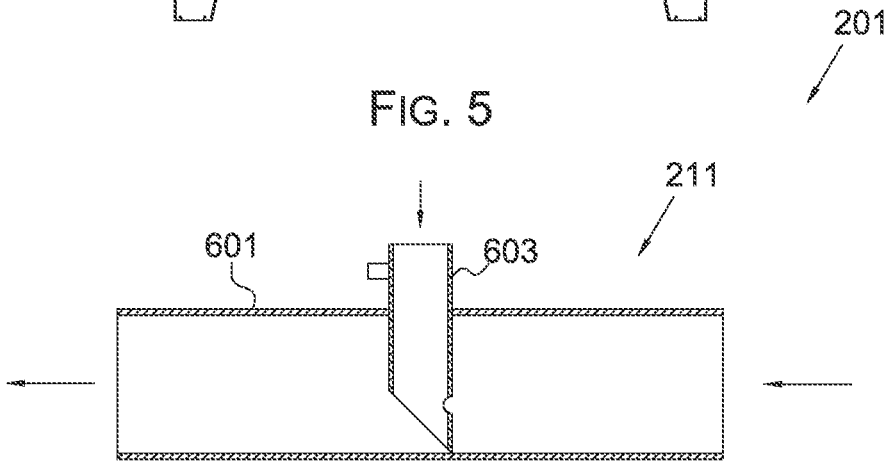
FIG. 6 is a schematic of the ejector of the system of FIG. 2.

In FIG. 6, a schematic of an ejector 211 is shown in fluid/gas communication with the equalization line 215 and the high-pressure line 203. It will be appreciated that the ejector 211 is configured to equalize high and low pressures passing through the lines and includes a first line 601 with high-pressure liquid/gas passing through and in communication with a low-pressure line 603 configured to inject low-pressure within the high-pressure line. In one contemplated embodiment, the ejector 211 creates a lower static pressure on the downstream fluid/gas like a venturi and decrease the temperature of hot gases going to the condenser.

Figure 7:
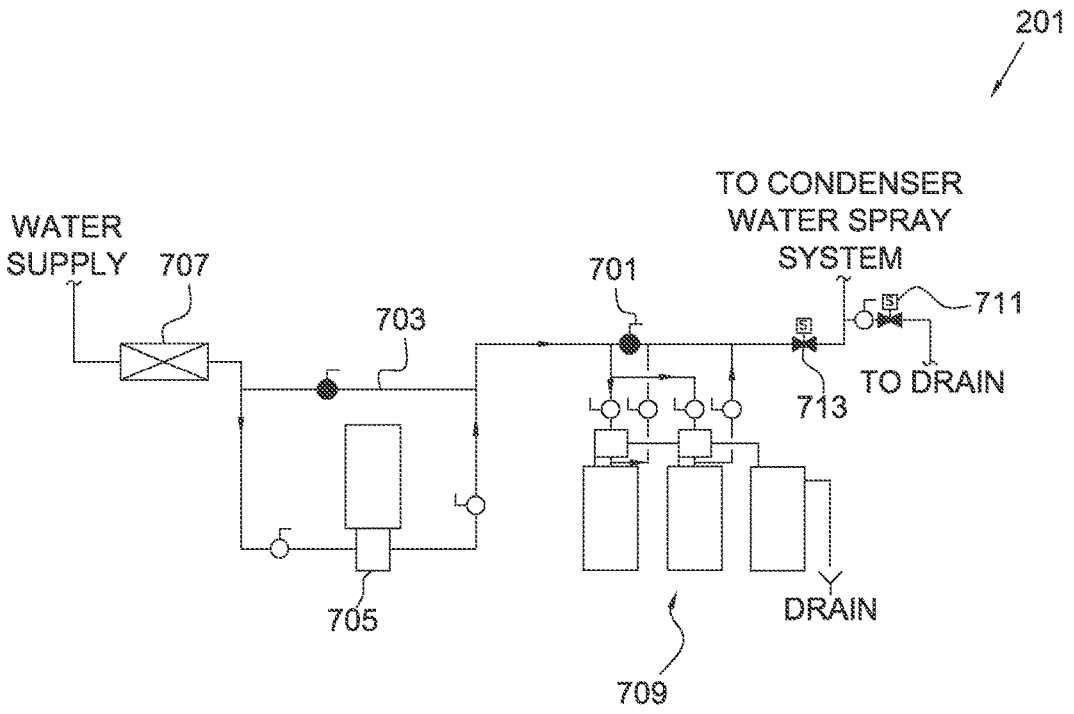
FIG. 7 is a schematic of the water spray system of the system of FIG. 2.
Figure 8:
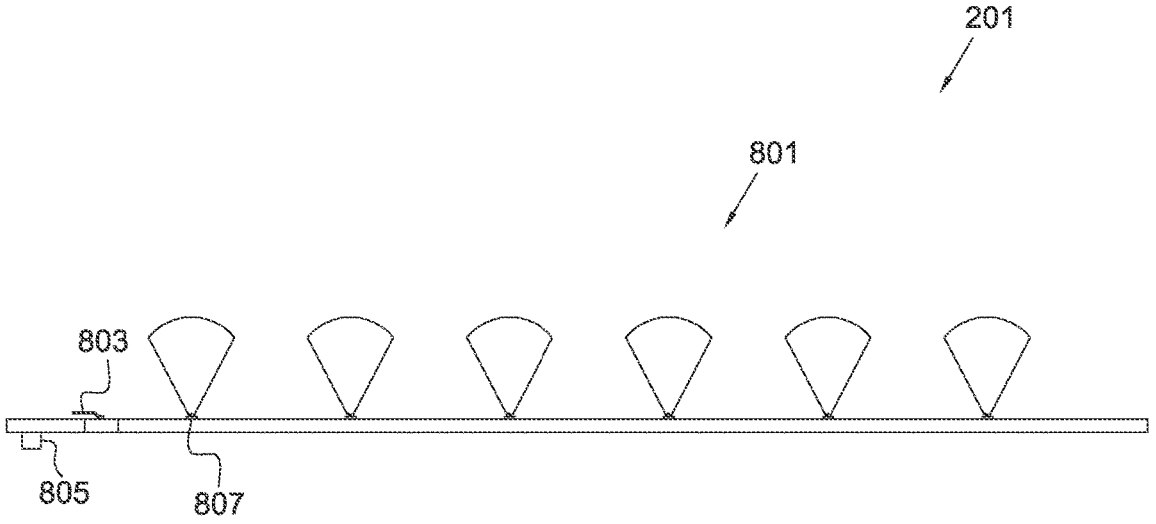
FIG. 8 is a side view of the spray nozzles of the system of FIG. 7.
Figure 9:
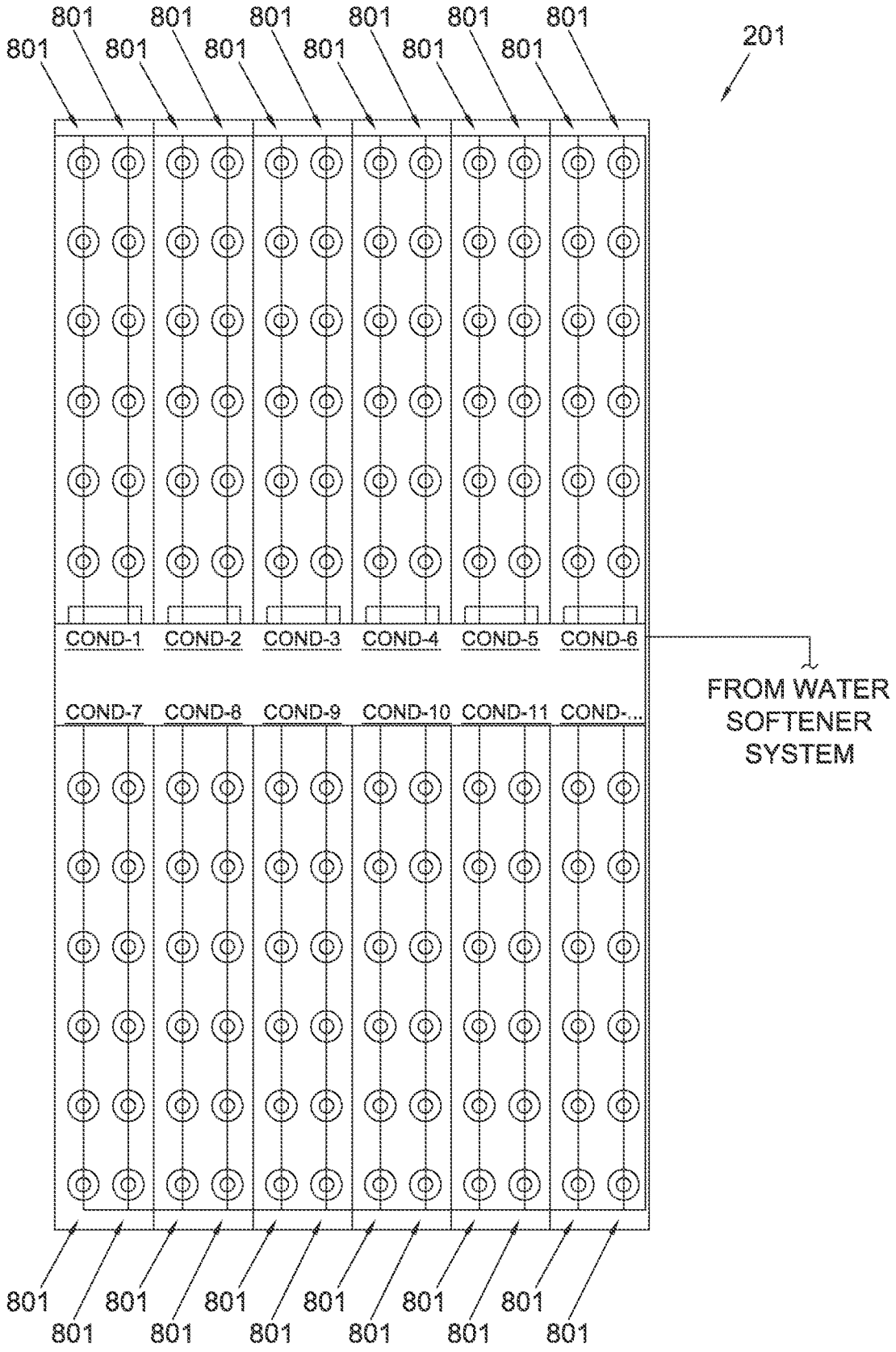
FIG. 9 is a top view of the spray nozzles of the system of FIG. 8.

Referring now to FIGS. 7-9 in the drawings, features of the adiabatic air cooling system of system 201 is shown. In the preferred embodiment, the adiabatic air cooling system is positioned within the condenser at a height preferably 48 inches above a bottom surface therein and configured to manipulate the air temperature. To achieve this feature, the system is provided with a plurality of valves 701, 711, and 713 in fluid communication with a line configured to channel the water from a water supply through a plurality of water softener tanks 709 and to the condenser. The system is further provided with a booster pump 705 and a double back check preventer 707. The booster pump 705 can be bypassed via a bypass line 703.

Disposed within the condenser is a plurality of spray assemblies 801 having a central conduit with a plurality of spray nozzles 807 secured thereto. The water exiting the spray nozzles 807 is regulated via one or more valves 803 and/or sensors 805. As shown in FIG. 9, a plurality of spray assemblies could be utilized to achieve the desired results. In one contemplated embodiment, the spray nozzles create a fog pattern to achieve optimal results.

Figure 10:
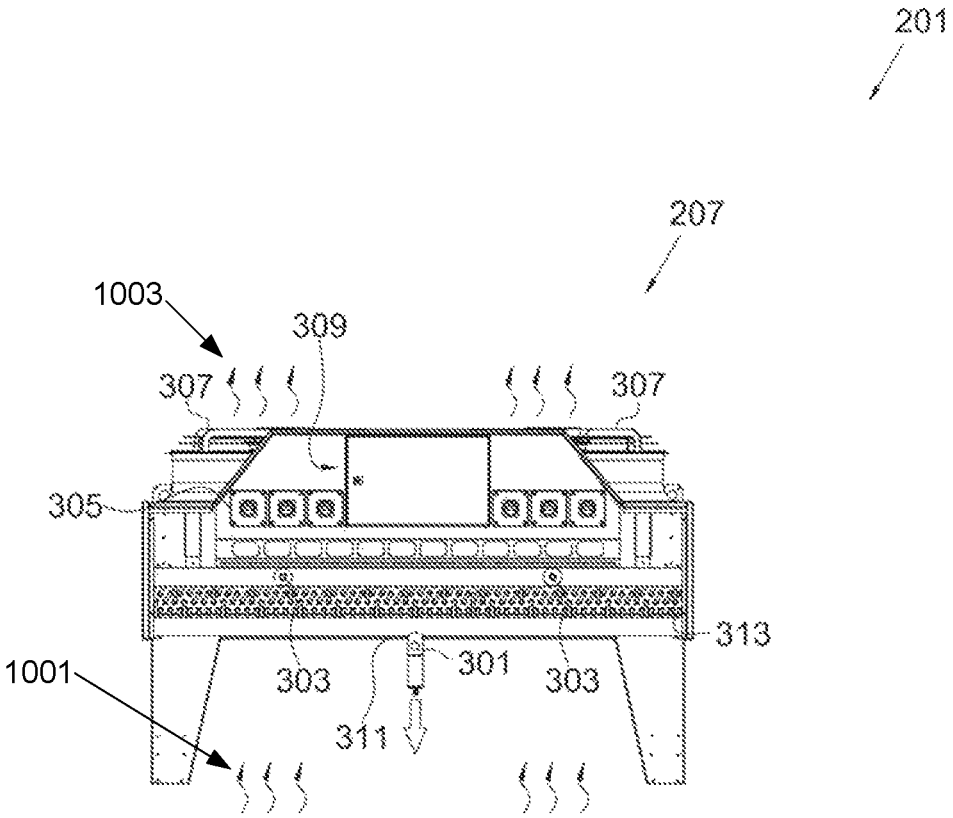
FIG. 10 is a front view of the system of FIG. 2 used to ventilate an area.

It is contemplated and will be appreciated that the system 201 evacuates a gas from the area where the system 201 is deployed as depicted by FIG. 10. It will be understood that certain fluids and gases present health hazards and must be evacuated from an area when present. Such a fluid/gas is ammonium hydroxide, exposure to this solution causes burning, breathing difficulties, rashes, shortness of breath and other harmful effects. Ammonium hydroxide has a boiling point of 76° F. so that when the liquid is spilled it rapidly evaporates filling the area with ammonia gas. The system 201 causes the gas 1001 to be pulled up and through the system 201 by fans 307. The gas is exhausted 1003 by fans 307 to facilitate the removal of the gas 1001 from the area.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A refrigeration system, comprising: a high-pressure main header gas line;

a low-pressure condensate discharge gas line; an ejector having:

a high-pressure section in communication with the high-pressure main header gas line; and a low-pressure line extending through a thickness of the high-pressure main header gas line and having an opening in fluid communication with the high-pressure main header gas line, the low-pressure line is configured to channel a low-pressure gas within a flow of high-pressure gas passing through the high-pressure main header gas line; a condenser having: a body with a bottom surface; a first port in gaseous communication with the high-pressure main header gas line; a second port in gaseous communication with the low-pressure condensate discharge gas line; wherein a gas travels through the first port, through the condenser, and exits through the second port; a purge assembly in communication with the condenser, the purge assembly is configured to purge air from the gas channeled through the low-pressure condensate discharge gas line; a control system conductively coupled to the purge assembly and configured to open and close a valve associated with the purge assembly.

* * * * *